US005605180A

United States Patent [19]

Tange et al.

[11] Patent Number: 5,605,180

[45] Date of Patent: Feb. 25, 1997

[54] BINDER

[75] Inventors: Yoshiaki Tange; Humiko Tange; Atsuko Kawamura, all of Nagoya, Japan

[73] Assignee: Kounan Kougyo Kabushikikaisya, Koutacho, Japan

[21] Appl. No.: 363,777

[22] Filed: Dec. 27, 1994

[30] Foreign Application Priority Data

Dec. 27, 1993 [JP] Japan ..... 5-353846

[51] Int. Cl.[6] ..... B21F 15/04

[52] U.S. Cl. ..... 140/119; 140/57; 140/93 A

[58] Field of Search ..... 140/57, 93 A, 140/119

[56] References Cited

U.S. PATENT DOCUMENTS 2,945,514 7/1960 Wyss ..... 140/93 R
3,368,590 2/1968 Welden .
3,369,573 2/1968 Baker et al. ..... 140/119
3,391,440 7/1968 Harms .
4,030,407 6/1977 Jesty et al. .

*Primary Examiner*—Lowell A. Larson
*Attorney, Agent, or Firm*—Cushman, Darby & Cushman

[57] ABSTRACT

A binder is provided for joining a plurality of objects together with a binding string. The binder includes a base member having a recess for receiving the objects. Structure for feeding the binding string is disposed behind the recess. A hook-shaped hand is provided for guiding the binding string around the objects and for causing a loose end of the binding string to turn back in a U shape while pressing the binding string against the objects to be bound, and for twisting the loose end of the binding string with another portion of the binding string to perform binding. The hook-shaped hand includes a slide base plate capable of moving backward and forward relative to the recess, a hook-shaped curved member rotatably coupled to the slide base plate and movable backward and forward in response to movement of the slide base plate, and a rotation mechanism for engaging and thereby rotating the hook-shaped curved member toward the recess in synchronized relation with forward movement of the slide base plate.

9 Claims, 17 Drawing Sheets

FIG. 17
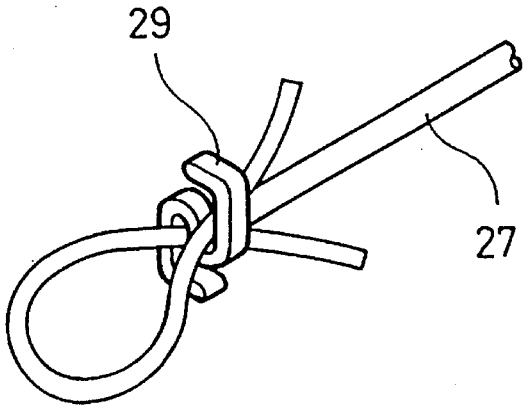
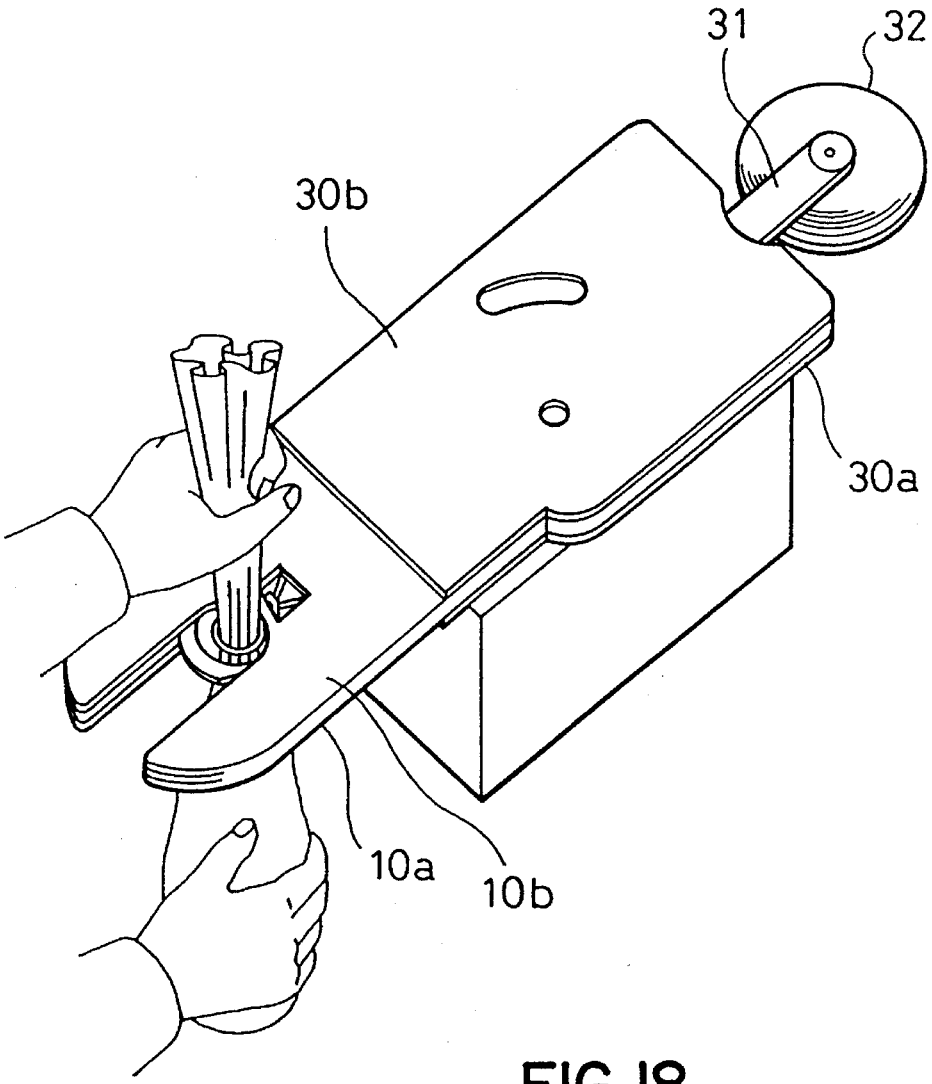
FIG. 18

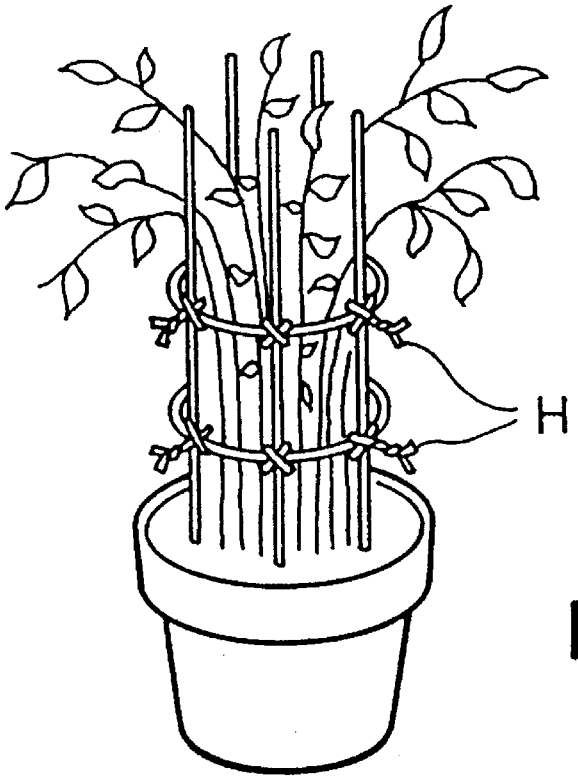
FIG. 19
FIG. 20
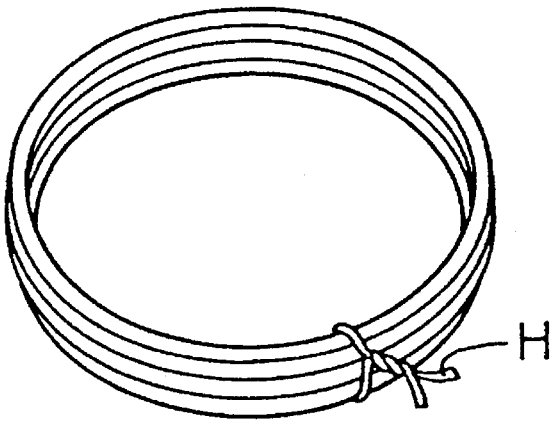

BINDER

BACKGROUND OF THE INVENTION

1. Field of the Invention

This invention relates to a binder and more particularly to a binder for binding rod-like objects by means of a string-like object (generally referred to as a binding string) such as a metallic wire that can be fastened.

2. Description of the Prior Art

A known conventional binder brings a continuous binding string around the opening or upper part of a plastic bag in a U shape, cuts the string to a suitable length, and fastened by twisting both ends of the string.

As one of this type of conventional binder, one is disclosed in a Japanese Unexamined Patent Application (Tokkai) Hei 2-166019.

The binder shown in the above-mentioned application has a girdling mechanism for bringing a metallic wire around rod-like objects held in a recess, and comprising a feeder chain made up of trapezoidal feeder blocks connected in series along their longer sides, a hand member secured to the projecting end of the feeder chain and having a wire holding mechanism at the end thereof, and a guide mechanism for causing the metallic wire to girdle the rod-like objects held in the recess by moving the feeder chain from one side of the recess to the other.

In the above constitution, when the guide mechanism causes the feeder chain to run and the hand member moves from one side to the other of the recess, the trapezoidal feeder blocks tend to come into contact with their side surfaces each other because of tension produced when the metallic wire is fed out. As a result, the feeder chain goes around the rod-like objects.

SUMMARY OF THE INVENTION

The above binder has disadvantages of increased number of components and increased number of man-hours in manufacture because a number of feeder blocks are joined together to form the feeder chain.

In view of the disadvantages described above, the object of this invention is to provide a binder comprising a reduced number of components resulting in a reduced number of man-hours in manufacture.

To accomplish the above object, the binder of this invention having a recess for receiving objects to be bound, feeds out a binding string from behind the recess, guides the string around the objects to be bound by means of a hook-shaped hand and causes the front end of the string to turn back in a U shape while pressing the string against the object to be bound, and twists the front end of the string around other portion of the string being fed out to perform binding, with the hand comprising; a slide base plate capable of moving back and forth relative to the recess, a hook-shaped curved member rotatably supported in front of the slide base plate, and a rotation mechanism for rotating the curved member toward the recess as the slide base plate engaging with the curved member for synchronous rotation moves forward.

In this type of invention, when the slide base plate moves forward, the rotation mechanism causes the curved member supported for rotation relative to the slide base plate to rotate toward the recess. As a result, the curved member rotates along a small radius to cause the binding string to encircle the circumference of the objects to be bound.

As described above, this invention provides a binder of a compact size with a reduced number of components and simplified constitution because, when the binding string is guided and pressed by the hook-shaped hand against the circumference of the objects to be bound, the slide base plate moves forward while causing the curved member to turn with a very small radius.

Another feature of the above binder of this invention is that the slide base plate, while swinging about a rotary shaft, moves back and forth relative to the recess.

In such an arrangement, since the slide base plate moves back and forth in a radial direction relative to the recess while swinging about the rotary shaft, accuracy is improved with a simple structure.

Still another feature of the above binder of this invention is that the rotation mechanism is constituted to be supported for rotation on the slide base plate in interlocked motion with the curved member, and to rotate the curved member when the slide base plate moves back and forth.

In such an arrangement, the rotary mechanism, while rotating on the slide base plate, causes the curved member to rotate when the slide base plate moves back and forth.

Thus, this invention simplifies the constitution of the binder since the the rotary mechanism, and while rotating along with the back and forth movement of the slide base plate, causes the curved member to rotate, requiring no additional drive source.

Still another feature of the binder of this invention is that the slide base plate is constituted to swing together with a rotating drive cam by the engagement between a driven cam and a driven cam.

In such an arrangement, the slide base plate is moved back and forth by the rotary movement of the drive cam.

Thus, this invention makes it easy to move the slide base plate back and forth by means of the drive with a simple structure.

BRIEF DESCRIPTION OF THE INVENTION

FIG. 17 is a perspective view of the operating state of the twisting head.

FIG. 18 is a perspective view of the binder in use.

FIG. 19 is a perspective view of flowerpot poles bound by means of the binder.

FIG. 20 is a perspective view of a looped wire bound by means of the binder.

DESCRIPTION OF THE PREFERRED EMBODIMENTS

Preferred embodiments of the invention will be hereinunder described in reference to the appended drawings.

Figure 1:
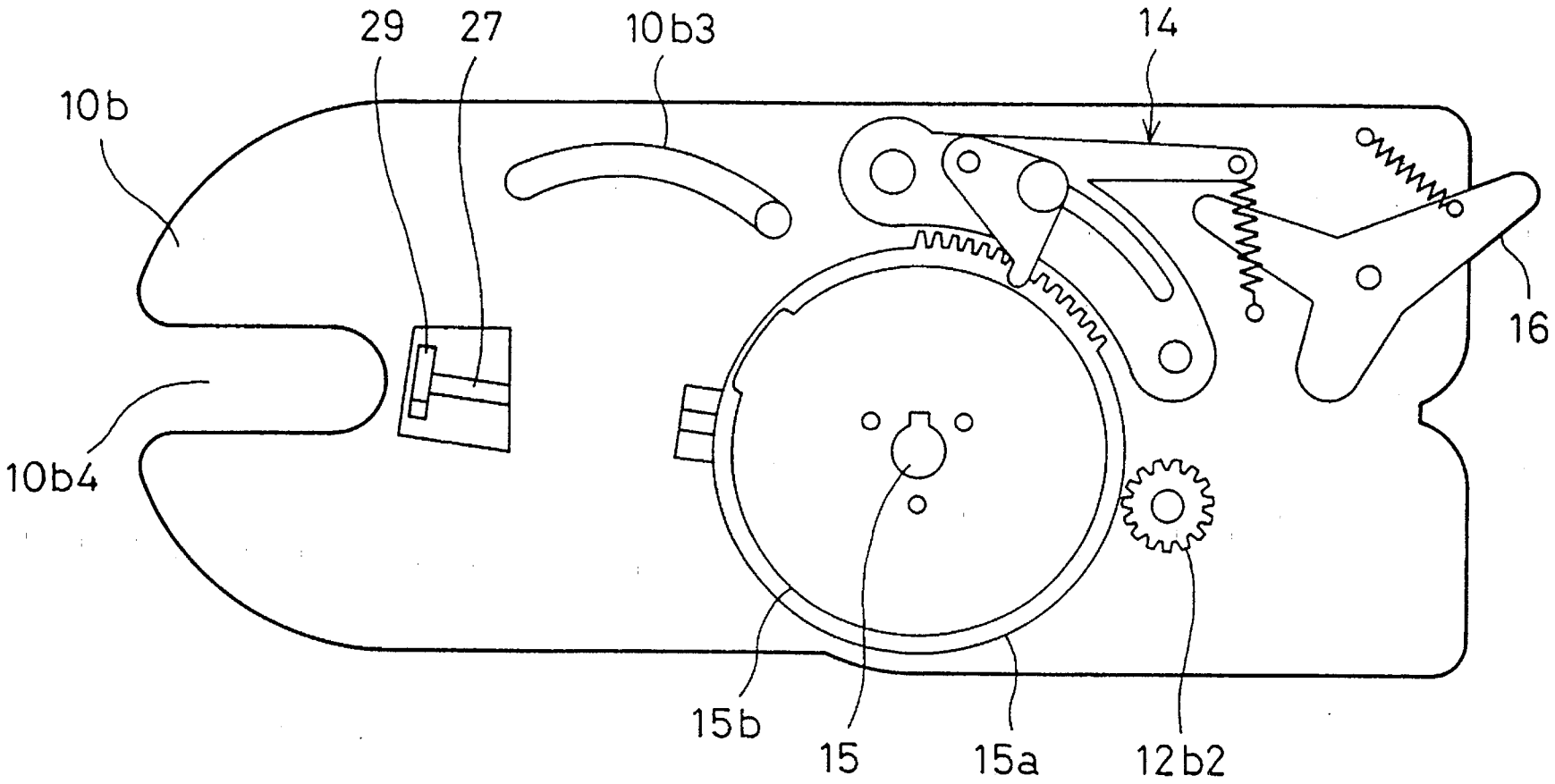
FIG. 1 is a right side view of a binder with its protective cover removed as an embodiment of the invention.
Figure 2:
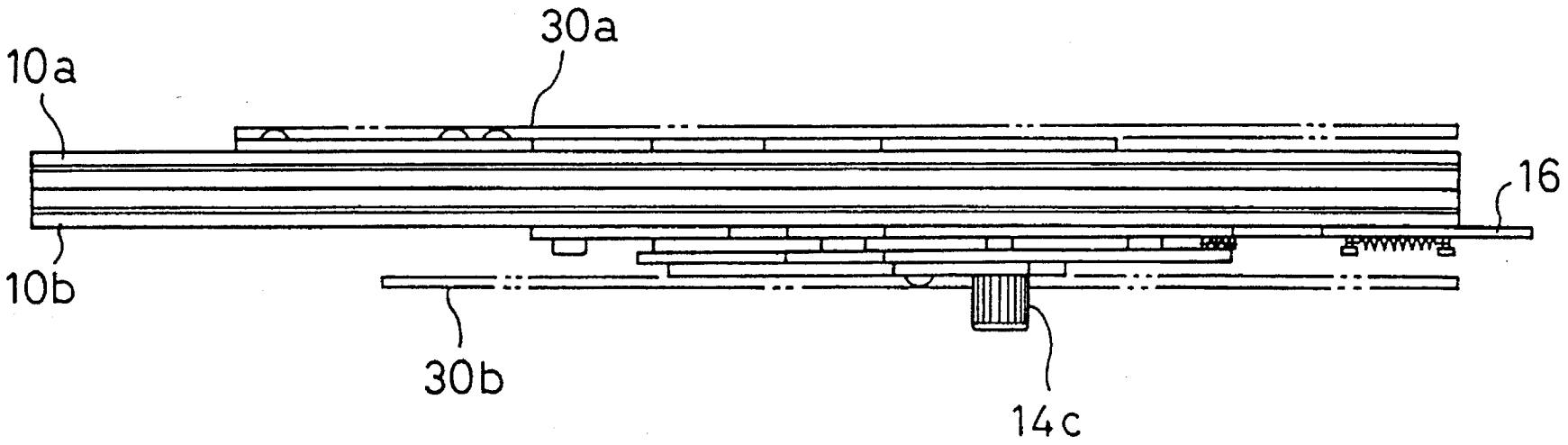
FIG. 2 is a plan view of the binder.
Figure 3:
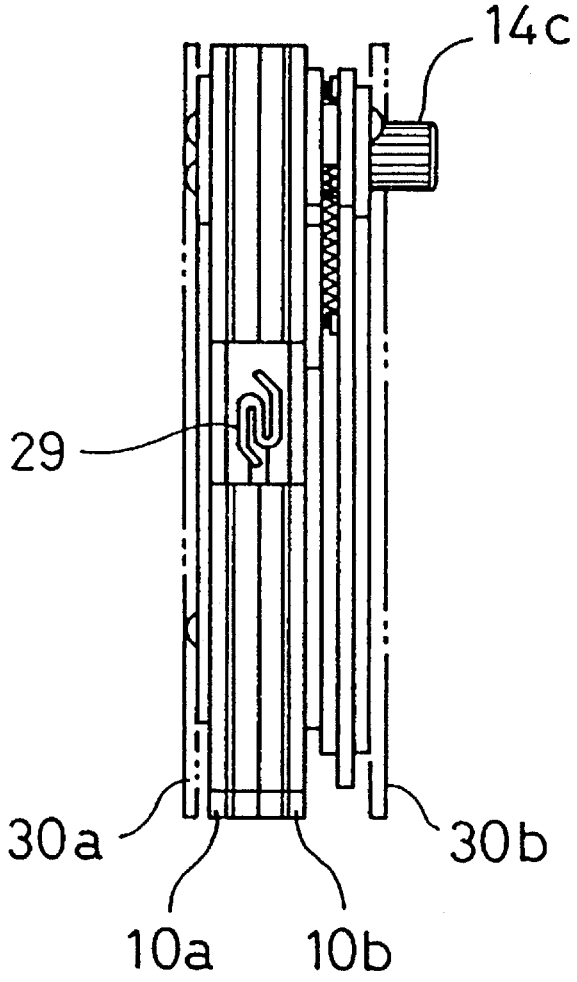
FIG. 3 is a front view of the binder.

FIG. 1 is a right side view of a binder as an embodiment of the invention with its protective cover removed. FIG. 2 is a plan view of the binder. FIG. 3 is a front view of the binder. The binder of the invention comprises two base plates (10*a*, 10*b*) held with a distance from each other with each plate having a recess at its end, and a drive shaft (15) passing through the base plates, and the base plates are driven by a cam (15*b*) secured to the drive shaft. The binding string is made of a metallic wire coated with a plastic film of a band shape.

Figure 4:
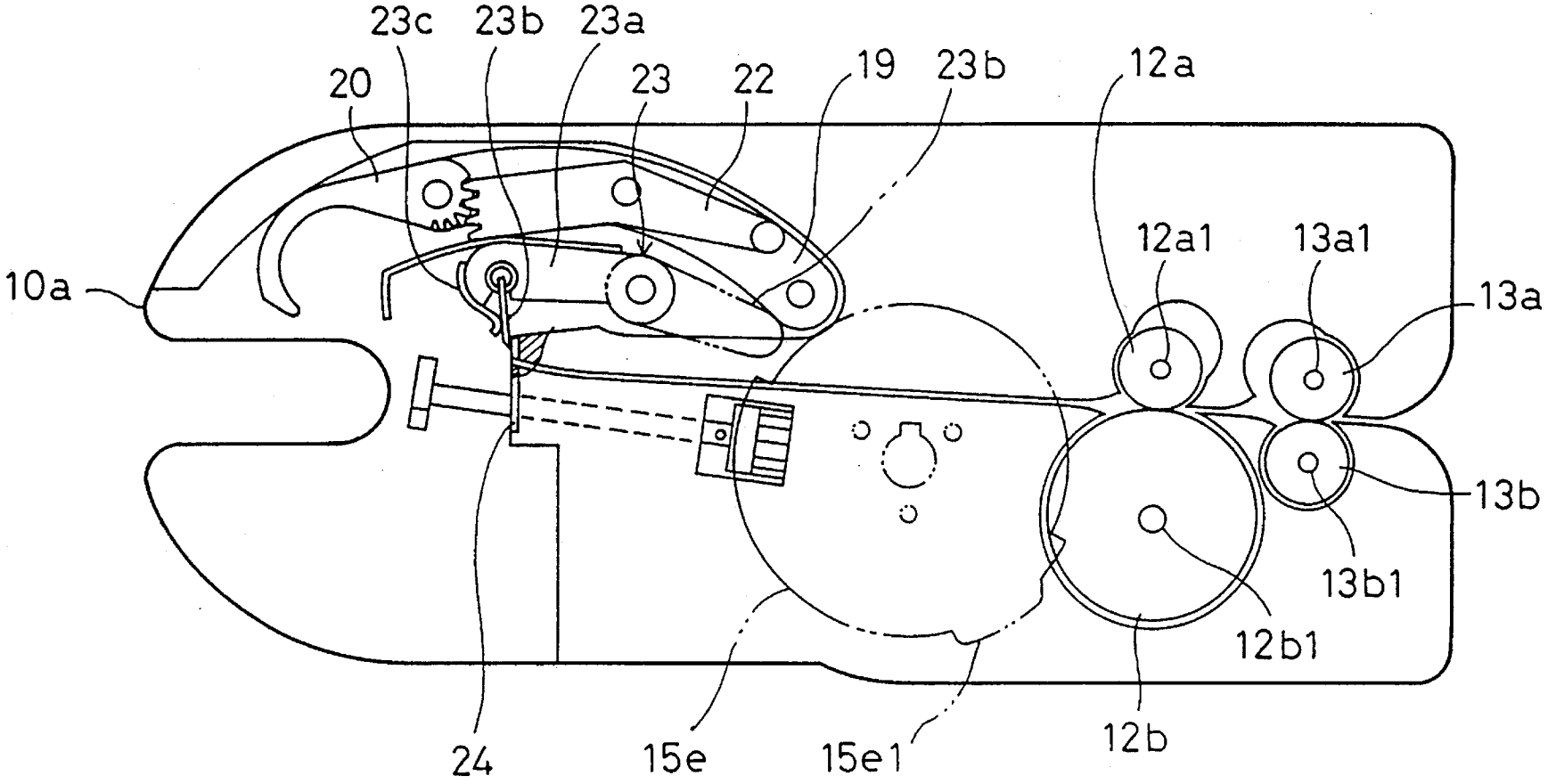
FIG. 4 is a side view of the binder with a base plate on the right side removed.
Figure 5:
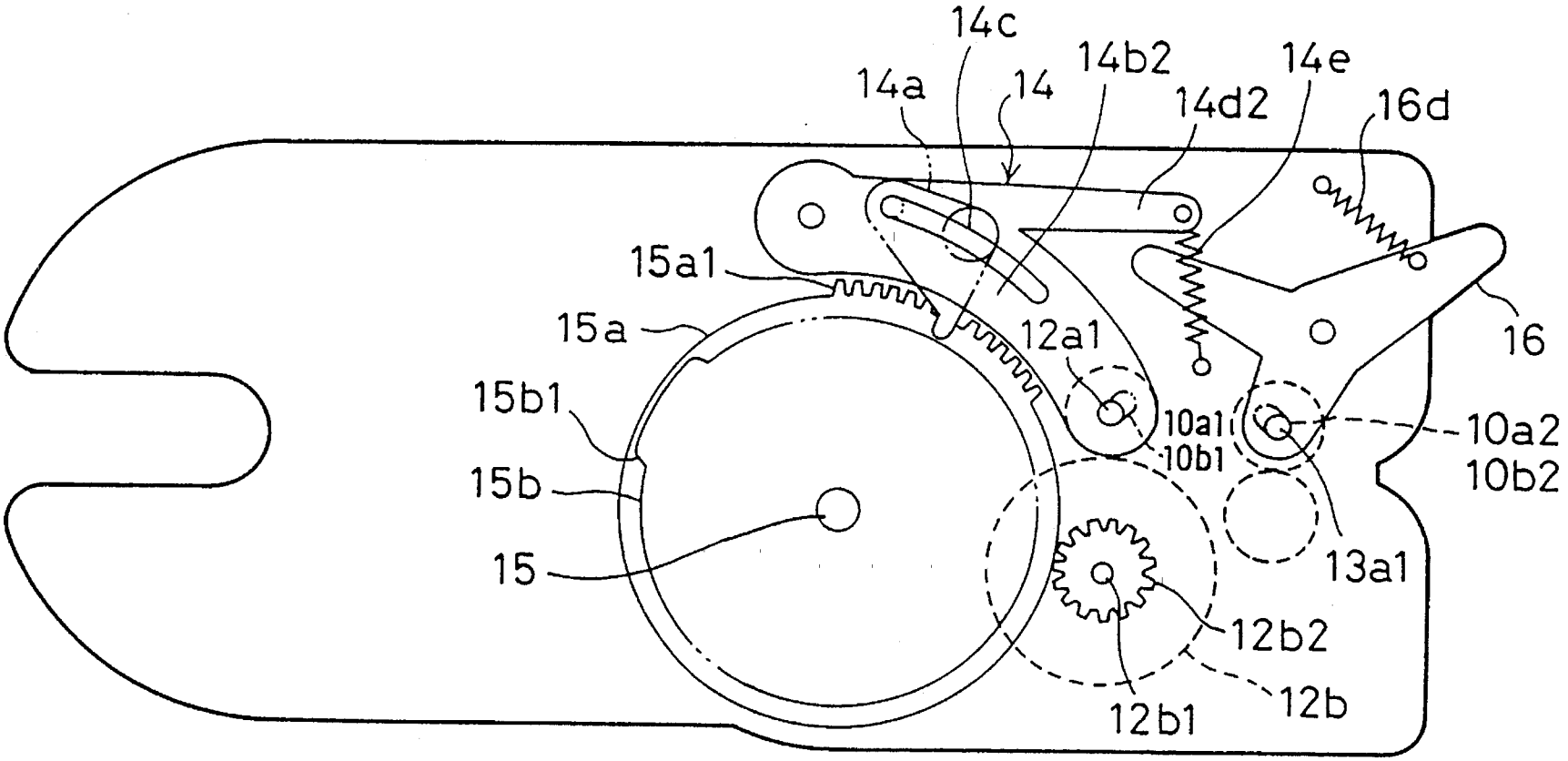
FIG. 5 is a side view of the release arm operation mechanism of the binder.

FIG. 4 schematically shows the state of the two base plates (10*a*, 10*b*). A binding string can be passed between upper and lower spacers (11*a*, 11*b*) disposed with a small gap from each other. The spacers (11*a*, 11*b*) are formed at their rear portions with recesses for receiving two sets of feed rollers. In the front side recesses, drive rollers (12*a*, 12*b*) are received. In the rear side recesses, reverse movement check rollers (13*a*, 13*b*) are received. Shafts (12*a*1, 13*a*1) of the upper side feed rollers (12*a*, 13*a*) are supported to be movable within slots (10*a*1, 10*b*1) formed in the base plates (10*a*, 10*b*) so that when the upper side feed rollers (12*a*, 13*a*) move upward they come apart from the lower side feed rollers (12*b*, 13*b*). Of the lower rollers, only the shaft (13*b*1) of the rear side roller (13*b*) is provided with a one-way clutch to permit only counterclockwise rotation. As shown in FIG. 5, the shaft (12*b*1) of the front side feed roller (12*b*) passes through the right side base plate (10*b*). A gear (12*b*2) is secured to the end of the shaft (12*b*1). The gear (12*b*2) is capable of engaging with a partially cogged gear (15*a*) secured to the drive shaft (15) so that the feed roller (12*b*) together with the shaft (12*b*1) is rotated when the drive shaft (15) rotates in the clockwise direction and the cogged portion (15*a*1) of the partially cogged gear (15*a*) engages with the gear (12*b*2). The drive shaft (15) is also provided with a feed amount regulating cam (15*b*) to be capable of coming into contact with a regulator plate (14*a*) of a release arm (14) disposed adjacent to a convex portion (15*b*1) of the cam (15*b*).

Figure 6:
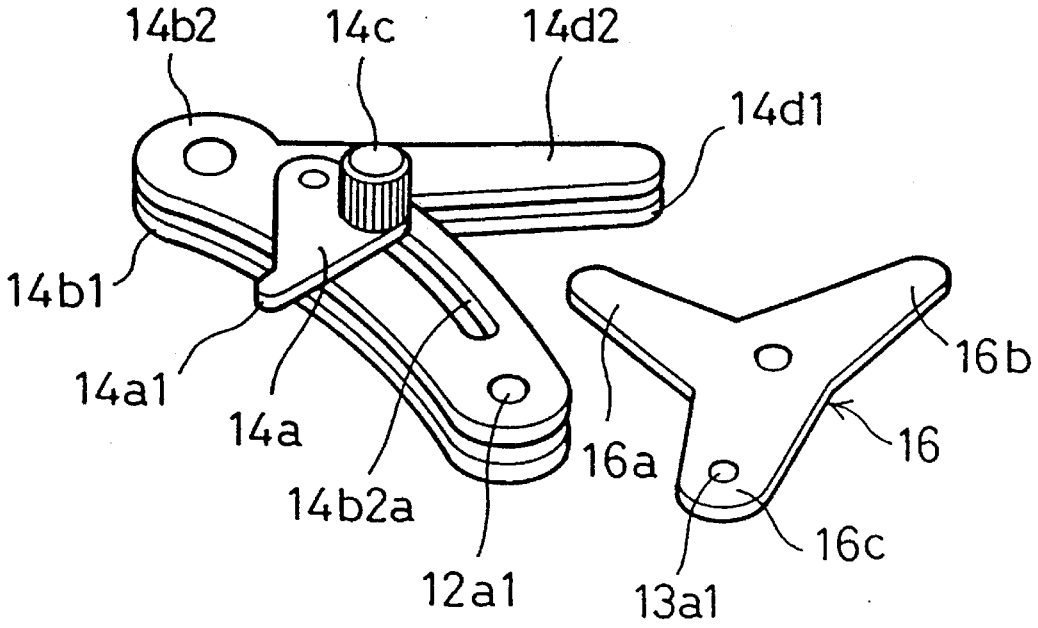
FIG. 6 is a perspective view of the release arm.
Figure 7:
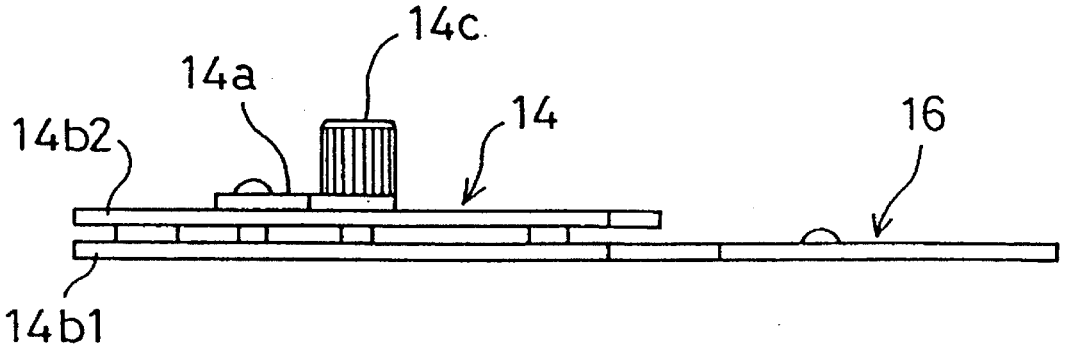
FIG. 7 is a view from under the release arm.

As shown in FIGS. 6 and 7, the release arm (14) comprises two identical plate members (14*b*1, 14*b*2) secured with a distance from each other with a regulator plate (14*a*) disposed to be slidable on the top surface, with its front end supported to be rotatable relative to the base plate (10*b*), and with its rear end supporting the shaft (12*a*1) of the feed roller (12*a*). The regulator plate (14*a*) is provided with a projection (14*a*1) projecting toward the drive cam (15*b*). A tightening bolt (14*c*) is disposed to pass through the regulator plate (14) and an elongate hole (14*b*2*a*) of the right side plate member (14*b*2) so as to engage with a nut on the back side. Both plate members (14*b*1, 14*b*2) are provided with horizontally projecting manual drive bars (14*d*1, 14*d*2), with the end of the manual drive bar (14*d*2) engaging with a spring (14*e*) so as to exert a clockwise force on the release arm (14). A release lever (16) supported to be rotatable relative to the base plate (10*b*) has three projections (16*a*, 16*b*, 16*c*) with one of the projections (16*a*) disposed at a lower portion of rotation range of the manual drive lever (14*d*1). The projection (16*b*) extends outside the the base plate (10*b*) and the projection (16*c*) supports a shaft (13*a*1) of the feed roller (13*a*). The release lever (16) is urged counterclockwise by a spring (16*b*) so that the projection (16*c*) presses the feed roller (13*a*) against the feed roller (13*b*) by way of the rotary shaft (13*a*1). When the projection (16*b*) is pressed to rotate clockwise, the projection (16*c*) causes the feed roller (13*a*) to moves away from the feed rollers (13*b*), and the projection (16*a*) comes into contact with the manual drive lever (14*d*1) of the plate member (14*b*1) to rotate clockwise, and causes the feed roller (12*a*) supported on the release arm (14) to move away from the feed roller (12*b*).

Figure 8:
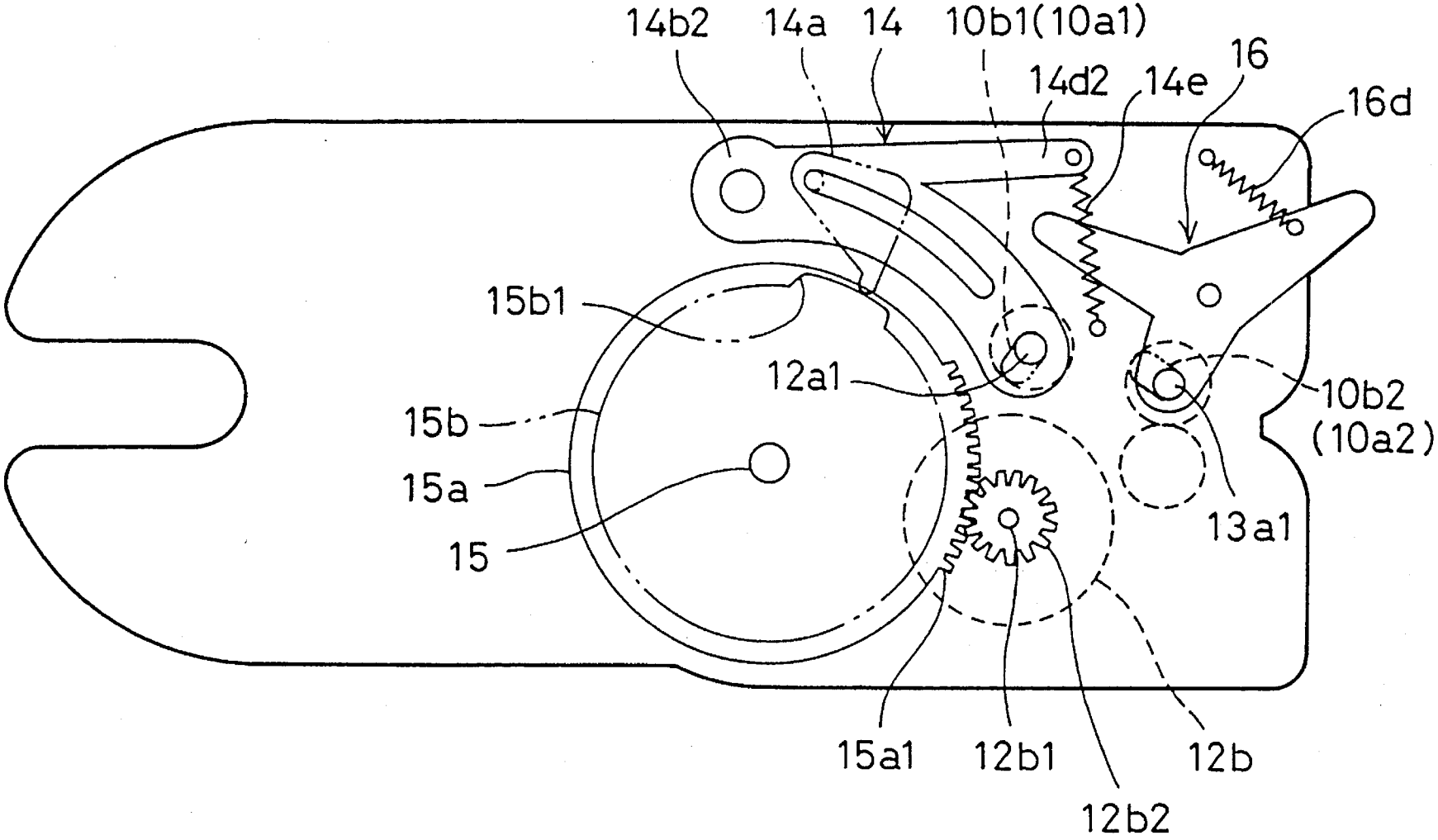
FIG. 8 is a side view of the release arm operation mechanism of the binder.

First the release lever (16) is rotated counterclockwise to separate the upper side feed rollers (12*a*, 13*a*) from the lower side rollers (12*b*, 13*b*) so that a binding string enters from behind and between the upper and lower spacers (11*a*, 11*b*). When the front end of the binding string reaches the front end of the lower spacer (11*b*), the release lever (16) is released, and the upper side feed rollers (12*a*, 13*a*) comes down to squeeze the binding string in cooperation with the lower side feed rollers (12*b*, 13*b*). When the partially cogged gear (15*a*) rotates together with the drive shaft (15) and the cogged portion (15*a*1) engages with the gear (12*b*2), the feed roller (12*b*) begins to rotate. Since the feed roller (12*b*) rotates counterclockwise, the binding string is fed forward. The binding string is fed while being pressed against the feed roller (12*b*) by the upper side feed roller (12*a*). When the feed amount regulation drive cam (15*b*) rotates and its projection (15*b*1) comes into contact with a projection (14*a*1) of the regulator plate (14*a*), the release arm (14) is raised to rotate counterclockwise, and the feed roller (12*a*) is separated from the feed roller (12*b*). As a result, the binding string is not fed even if the feed roller (12*b*) rotates. As described above, securing position of the regulator plate (14*a*) on the plate member (14*b*2) is adjustable using the tightening bolt (14*c*). If the regulator plate (14*a*) is secured to a relatively forward position on the plate member (14*b*2), the projection (15*b*1) comes into contact with the projection (14*b*1) at a relatively early timing, and the feed duration of the binding string becomes relatively shorter, and vice versa. FIG. 8 shows a state in which the drive shaft (15) has rotated and the projection (15*b*1) of the feed amount regulating drive cam (15*b*) has come into contact with the regulator plate (14*a*), and the feed roller (12*a*) has been separated from the feed roller (12*b*).

Figure 9:
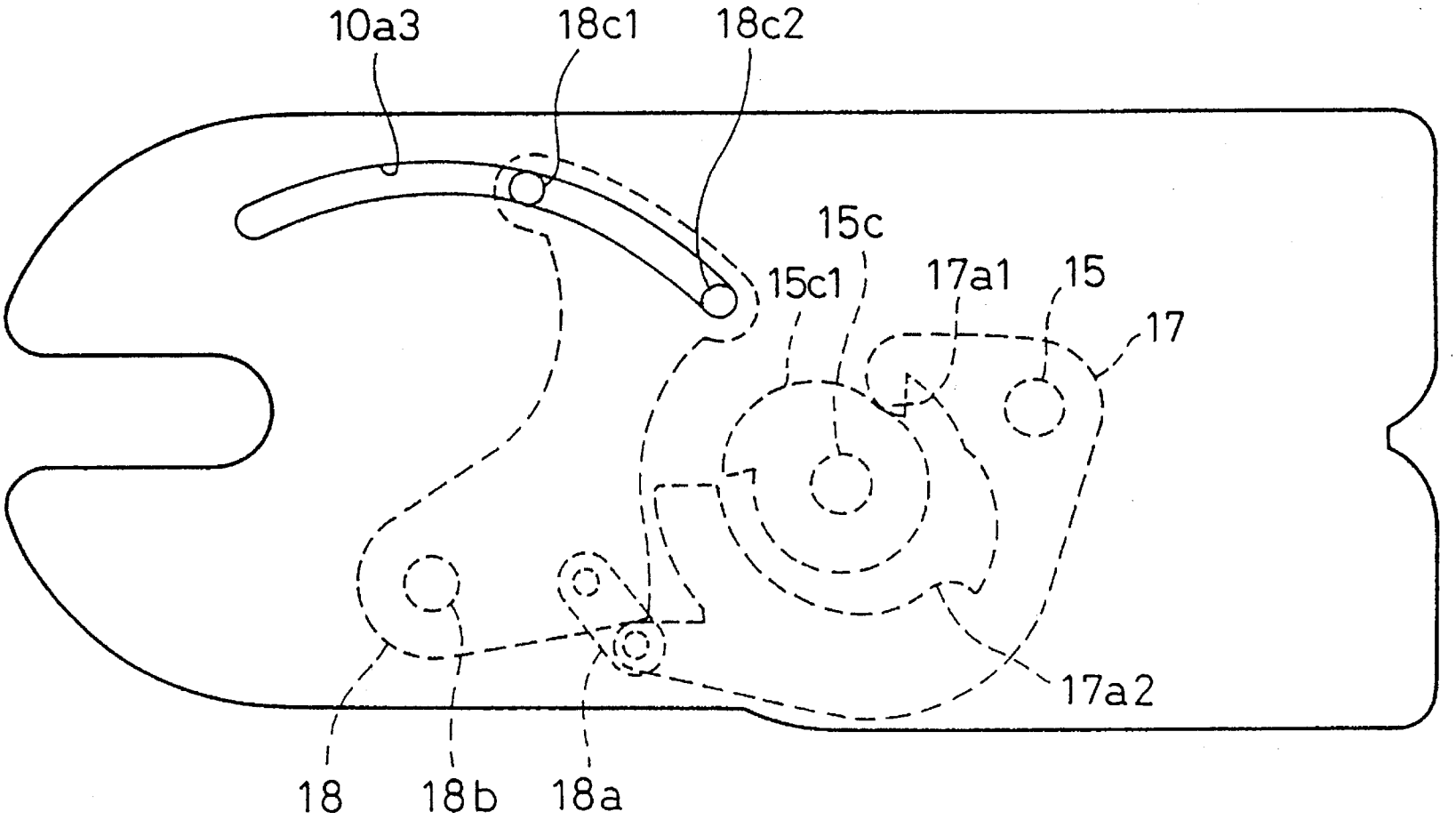
FIG. 9 is a side view of the drive arm operation mechanism.

In the left portion of the base plate (10*a*) as shown in FIG. 9, a manual drive cam (15*c*) is secured to the drive shaft (15). In the rear portion of the base plate (10*a*) is arranged a swing cam (17) supported to be rotatable relative to the base plate (10*a*). The swing cam (17) is formed with a recess (17*a*) surrounding the manual drive cam (15*c*) and having two projections (17*a*1, 17*a*2) at opposite positions each other with respect to the drive shaft (15). When the projection (15*c*1) of the manual drive cam (15*c*) comes into contact with one side and rejects it, the swing cam (17) rotates, and the other side moves toward the manual drive cam (15*c*).

When the projection (15*c*) comes into contact with the opposite side, the swing cam (17) rotates toward opposite side. Thus, the swing cam (17) makes one cycle of back and forth swing as the manual drive cam (15*c*) makes one turn.

A drive arm (18) is rotatably supported in front of the drive shaft (15), in the left portion of the base plate (10*a*), parallel to the base plate (10*a*), and connected to the swing cam (17) by way of a link (18*a*). The drive arm (18) is provided with support pins (18*c*1, 18*c*2) equally distant from the rotary shaft (18*b*). The support pins (18*c*1, 18*c*2) extend through the base plate (10*a*) up to a position between the base plates (10*a*, 10*b*). The base plate (10*a*) is formed with an arcuate slot (103*a*) along the rotary locus of the support pins (18*c*1, 18*c*2).

Figure 10:
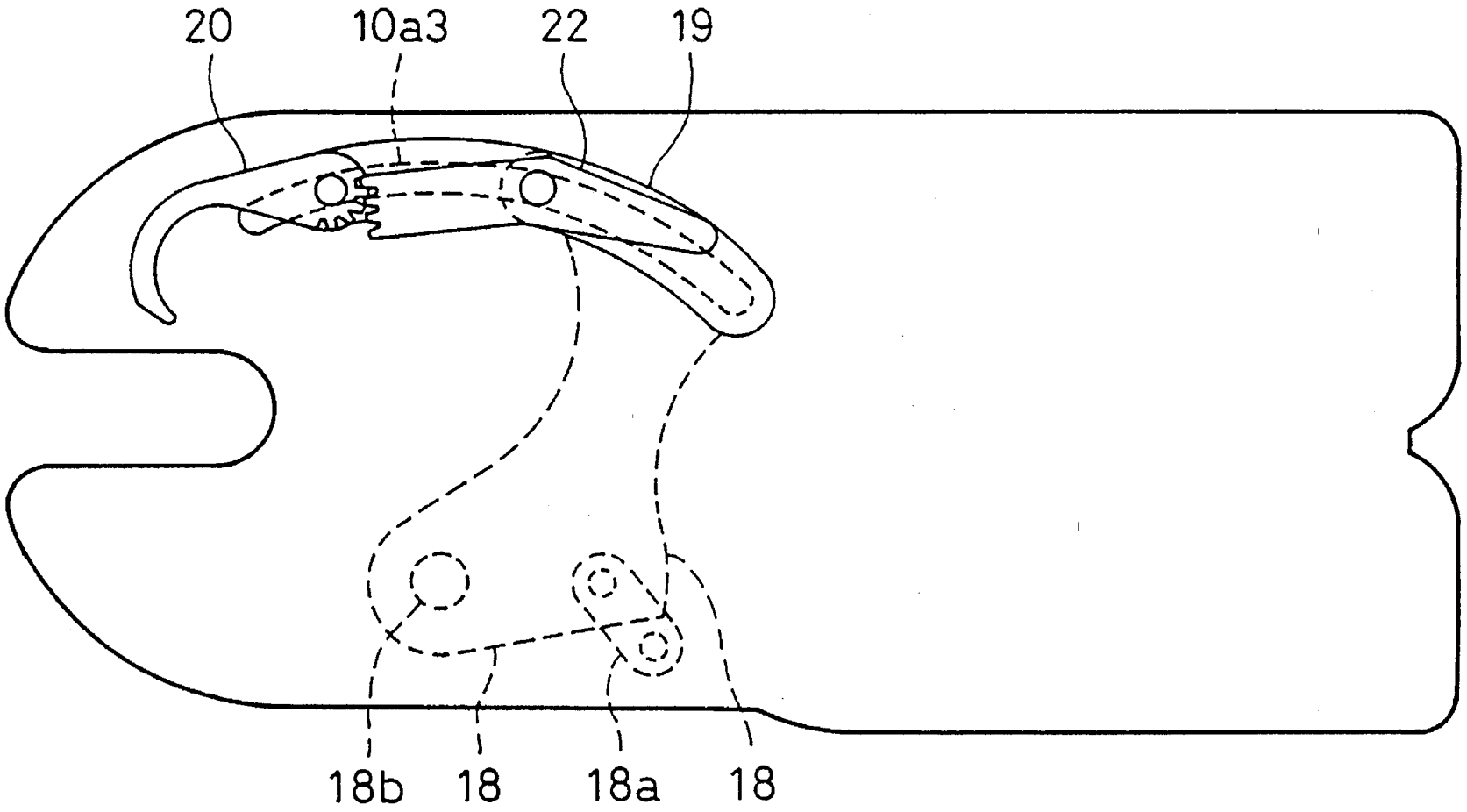
FIG. 10 is a side view of the driving relationship between the drive arm and the slide base plate.
Figure 11:
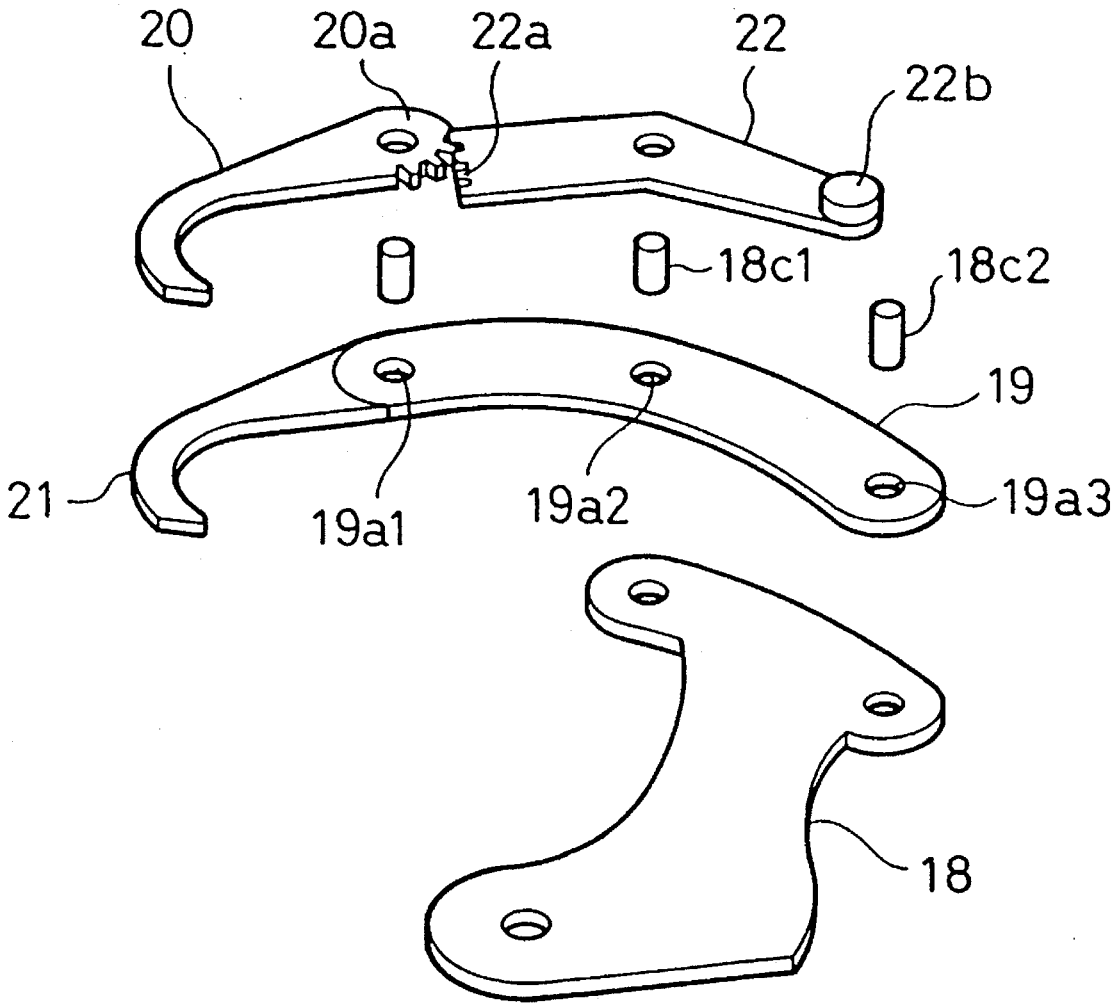
FIG. 11 is an exploded view of components around the slide base plate.

As shown in FIGS. 10 and 11, an arcuate slide base plate (19) connected to the support pins (18*c*1, 18*c*2) is disposed between the base plates (10*a*, 10*b*). The slide base plate (19) is formed with three through holes (19*a*1, 19*a*2, 19*a*3) from front to rear, with the support pins (18*c*1, 18*c*2) inserted in the center and rear through holes (19*a*2, 19*a*3) respectively. Therefore, when the drive arm (18) connected to the swing cam (17) swings back and forth, the slide base plate (19) is caused to move back and forth along an arc by the support pins (18*c*1, 18*c*2). A root portion (20*a*) of a curved member (20) with a hooked end is rotatably supported in a through hole (19*a*1) formed in th front portion of the slide base plate (19). A back plate (21) having generally the same thickness and shape with those of the slide base plate (19) with the portion corresponding to the root portion (20*a*) removed is joined to the front end portion of the curved member (20). Part of the circumference of the root portion (20*a*) of the curved member (20) is formed with gear teeth (20*a*1). A rocker arm (22) with its front end having a gear portion (22*a*) for engagement with the gear (20*a*1) is supported for free rotation by the support pin (18*c*1) passing through the center through hole (19*a*2) in the slide base plate (19). A guide slide pin (22*b*) is erected at the right end of the rocker arm (22). As shown in FIG. 1, a guide slot (10*b*3) is formed in the base plate (10*b*) to receive the guide slide pin (22*b*) and permit it to slide along the slot.

Figure 12:
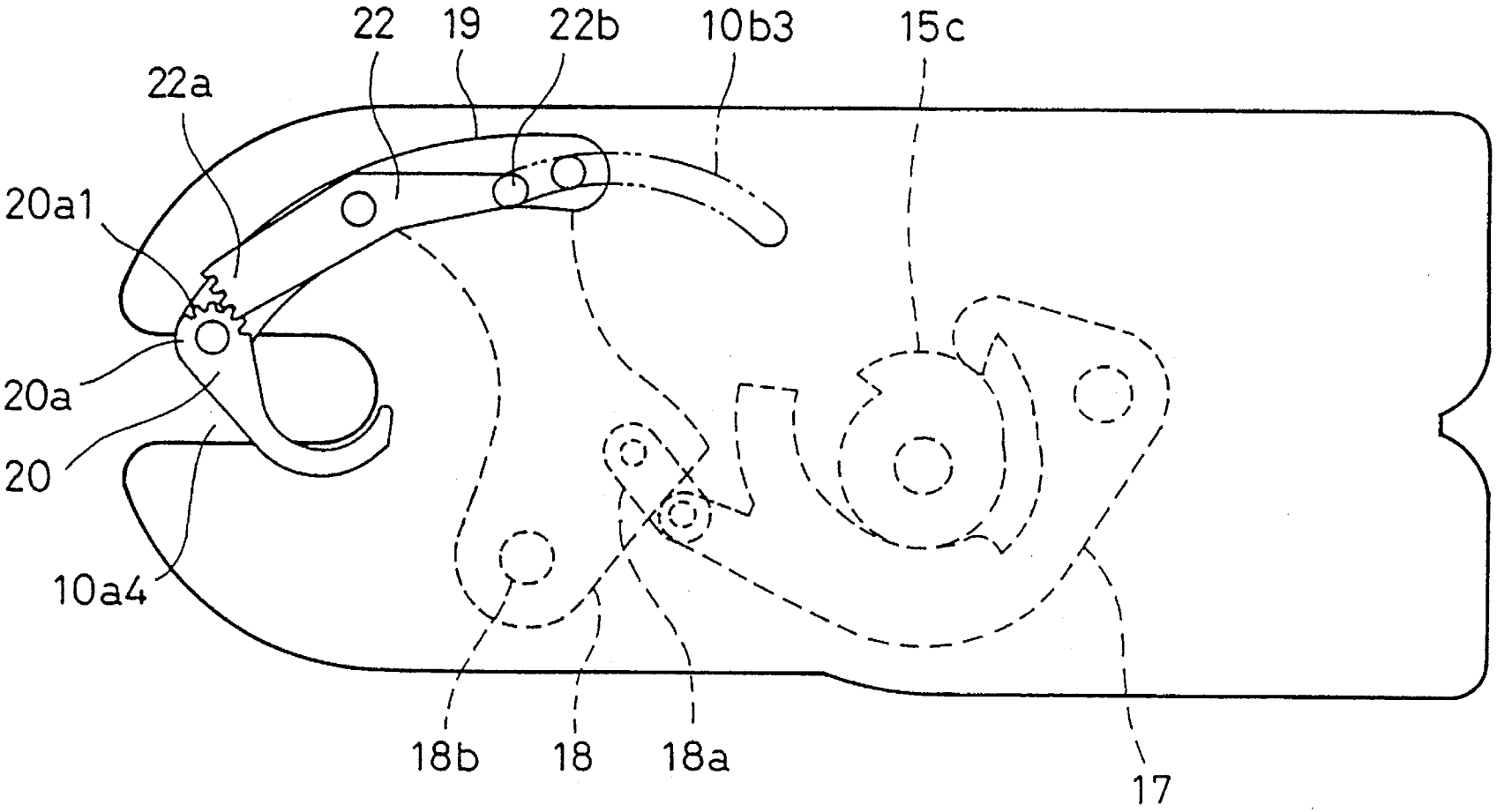
FIG. 12 is a side view of the driving relationship between the drive arm and the slide base plate.

When the slide cam (17) swings back and forth, the drive arm (18) also swings back and forth, and the slide base plate (19) is driven along an arc by the support pins (18*c*1, 18*c*2). Along with this, the curved member (20) and the rocker arm (22) held at the front end of the slide base plate (19) also move back and forth. Since the guide slide pin (22*b*) of the rocker arm (22) moves back and forth along the drive guide slot (10*b*3) in the base plate (10*b*) in an arcuate path, the rocker arm (22) rotates about the center support pin (18*c*1) of the slide base plate (19), and causes the gear portion (22*a*) to engage with the gear (20*a*1) of the root portion (20*a*) of the curved member (20). Here, the rotation of the rocker arm (22) is clockwise and that of the curved member (20) is counterclockwise. As shown in FIG. 12, the curved member (20) moves forward while rapidly crossing the slots (10*a*4, 10*b*4) in the front portion of the base plates (10*a*, 10*b*) and turn around inward. When the curved member (20) moves in the opposite direction, its movement is opposite to the above.

Figure 13:
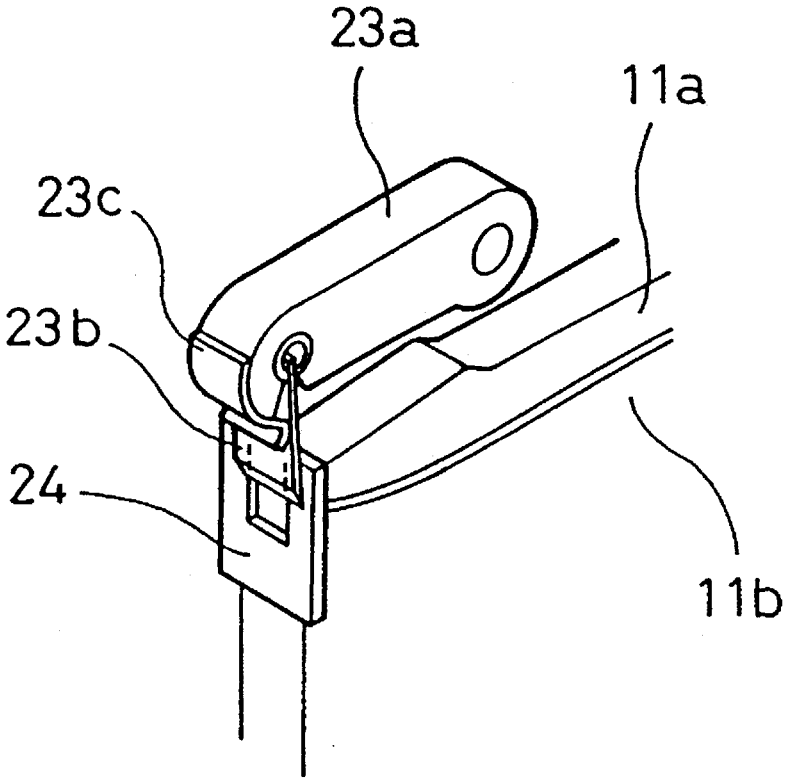
FIG. 13 is a perspective view of the cutter.

As shown in FIGS. 4 and 13, a cutter (23) comprises a cutter body (23*a*) held between the base plates (10*a*, 10*b*), a cutter blade (23*b*) held for movement within a small range at the front end of the cutter body (23*a*), a spring (23*c*) for urging the cutter blade (23*b*) counterclockwise, and a cutter drive arm (23*d*) secured to the rotary shaft of the cutter body (23*a*) on both sides of the base plate (10*b*). A U-shaped counter blade (24) is disposed with its opening directed upward along the continuous portions of the spacers (11*a*, 11*b*). The binding string is fed through the inside of the counter blade (24) and between the spacers (11*a*, 11*b*).

Figure 14:
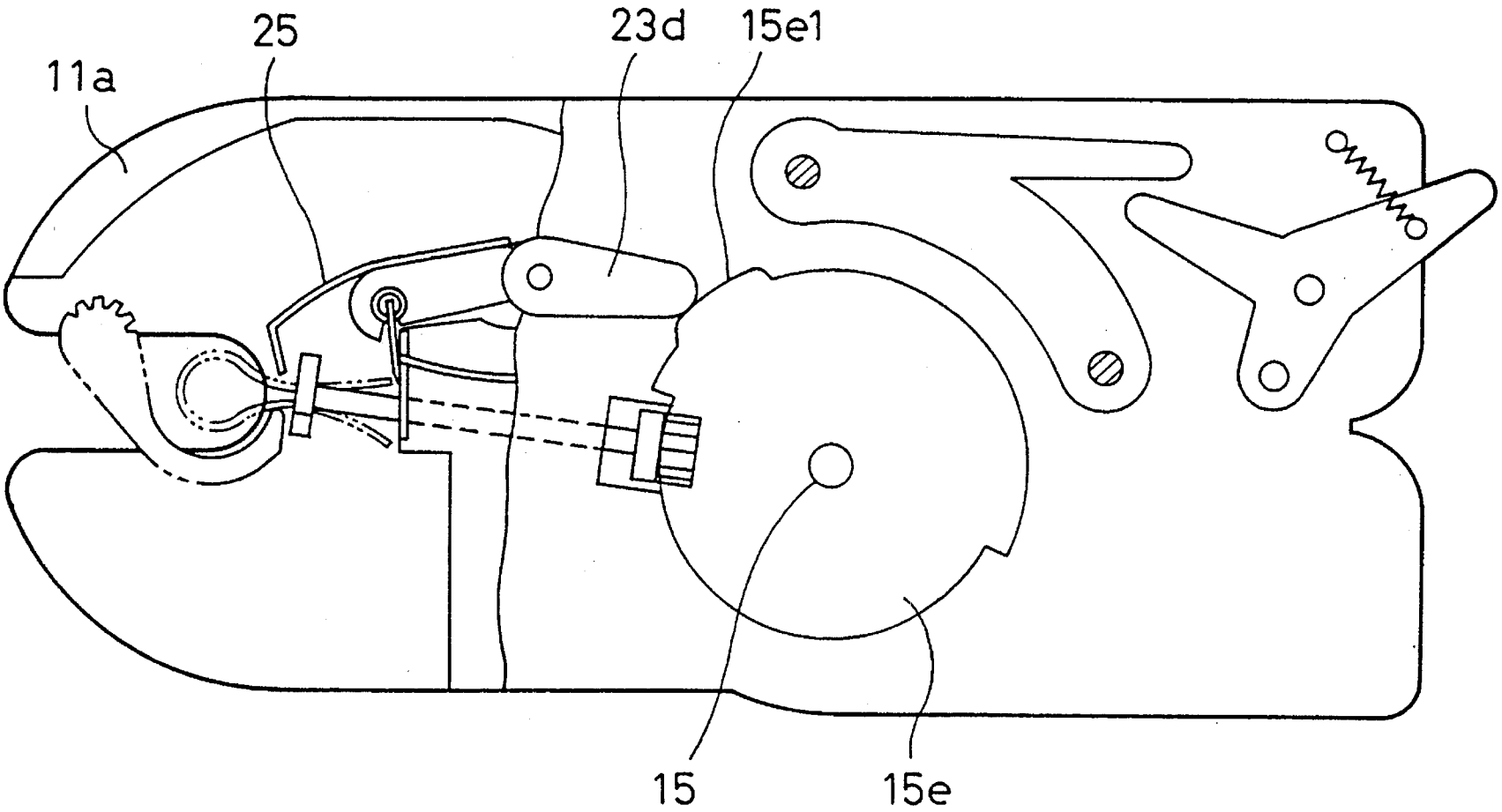
FIG. 14 is a side view of the drive mechanism of the cutter.

A rotary cam (15*e*) is disposed to face the end of the cutter drive arm (23*d*) on the right of the base plate (10*b*). As shown in FIG. 14, when the rotary cam (15*e*) rotates, a projection (15*e*1) formed on the periphery comes into contact from under with the cutter drive arm (23*d*) to rotate the cutter drive arm (23*d*) counterclockwise. When the cutter drive arm (23*d*) rotates counterclockwise, the cutter blade (23*b*) moves up and down while its tip slides over the counter blade (24) to cut the binding string by a guillotine action in cooperation with the counter blade (24) when the cutter blade (23*b*) moves downward. Here, a holding plate (25) extending forward with its end bent downward is secured to the top surface of the cutter body (23*a*).

Figure 15:
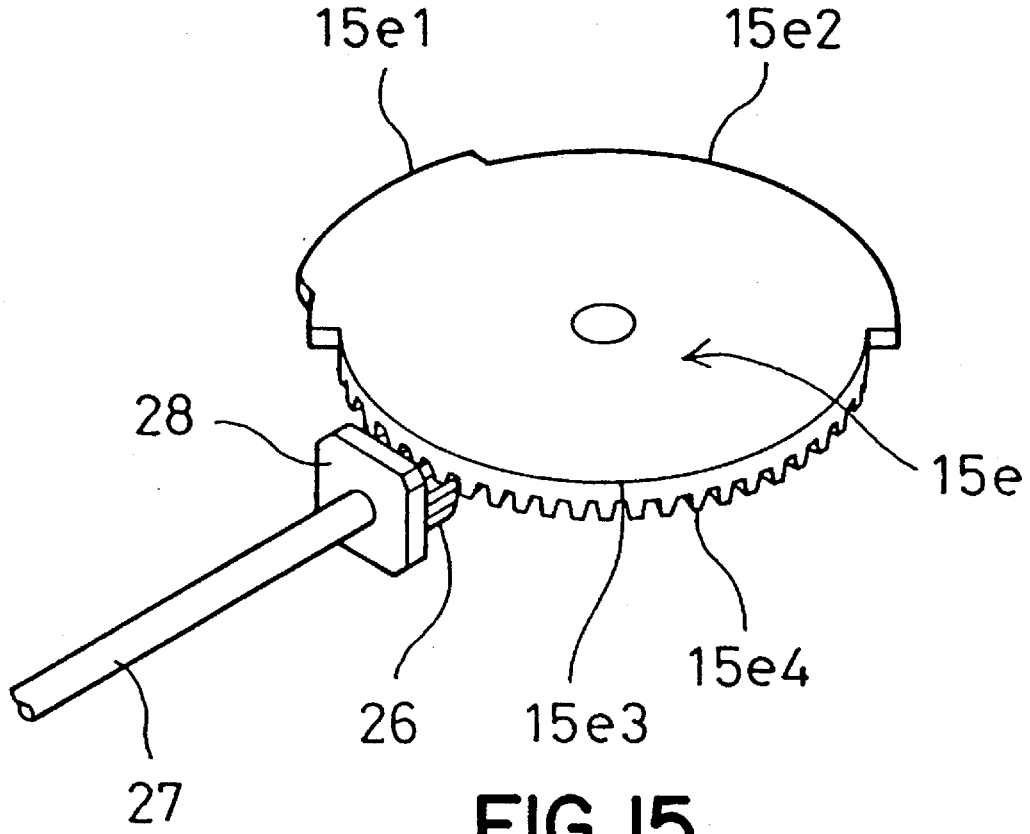
FIG. 15 is a perspective view of the drive mechanism for the twisting shaft.
Figure 16:
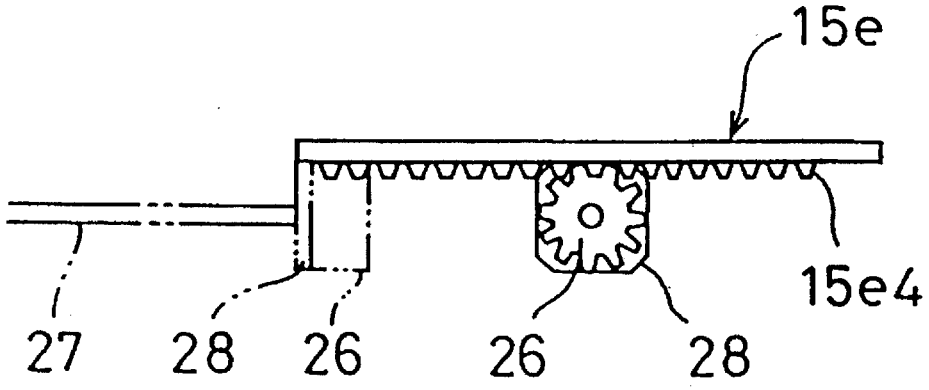
FIG. 16 is a side view of the drive mechanism of the twisting shaft.

The circumference of the rotary cam (15*e*) is provided, in addition to the projection (15*e*1), with a larger radius portion (15*e*2) and a smaller radius portion (15*e*3). As shown in FIG. 15, an arcuate row of teeth (15*e*4) extending downward are formed on the circumference of the smaller radius portion (15*e*3) so as to engage with a gear (26). The teeth row (15*e*4) is not formed in the larger radius portion (15*e*2). The gear (26) is secured to an end of a twisting shaft (27) passing through the spacer (11*b*). A square stopper (28) is secured adjacent to the gear (26). Since the stopper (28) is within the rotating locus zone of the larger radius portion (15*e*2), the stopper (28) prevents the twisting shaft (27) from rotating when the stopper (28) is covered by the larger radius portion (15*e*2) as one side of the stopper (28) is in contact with the back surface of the larger radius portion (15*e*2). However, when the smaller radius portion (15*e*3) comes to face the stopper (28), the twisting shaft (27) is permitted to rotate as the gear (26) engages with the teeth row (15*e*4).

The twisting shaft (27) extends through the spacer (11*b*) up to L position before the recesses (10*a*4, 10*b*4). As shown in FIG. 17, a generally S-shaped twisting head (29) is secured to the end of the twisting shaft (27). An electric motor is disposed to the left of the base plate (10*a*) so as to drive the drive shaft (15) by way of a gear (not shown). The electric motor drives the drive shaft (15) by one turn every time the switch (not shown) is operated.

The operation of the embodiment constituted as described above will be described below.

First when a finger is placed on the projection (16*b*) of the release lever (16) to press it down in the clockwise direction, the release lever (16) rotates, and the feed roller (13*a*) with its rotary shaft (13*a*1) supported by the projection (16*c*) moves away from the feed roller (13*b*). At the same time, the projection (16*a*) comes from under into contact with the manual drive lever (14*d*1) of the release arm (14) to rotate the release arm (14) counterclockwise. This causes the feed roller (12*a*) with its shaft (12*a*1) held by the end of the release arm (14) to move away from the feed roller (12*b*). As a result, the feed rollers (12*a*, 12*b*) move away from the feed rollers (13*a*, 13*b*) to produce an elongate space between the spacers (11*a*, 11*b*) through which the binding string is inserted. When the binding string is moved to the front end of the spacer (11*b*), the operators finger is released from the release lever (16). This causes the upper side feed rollers (12*a*, 13*a*) to be pressed down against the lower side feed rollers (12*b*, 13*b*) by the contraction force of the springs (14*e*, 16*b*) so that the binding string is held between the feed rollers.

When rod-like objects to be bound are inserted in the recesses (10*a*4, 10*b*4) and the drive shaft (15) is driven by the electric motor, the gear portion (15*a*1) of the partially cogged gear (15*a*) comes to engage with the gear (12*b*) secured to the shaft (12*b*1) of the feed roller (12) to rotate the feed roller (12) counterclockwise. The feed roller (12*b*) rotates while the gear portion (15*a*1) of the partially cogged gear (15*a*) is in engagement with the gear (12*b*) and the binding string is fed toward the recesses (10*a*4, 10*b*4).

As the drive shaft (15) rotates and the binding string is fed out, the projection (15*c*1) of the manual drive cam (15*c*) comes into contact with the projection (17*a*1) of the swing cam (17) to rotate the swing cam (17) clockwise as seen in FIG. 9. Then the drive arm (18) connected to the swing cam (17) is also rotated clockwise by the link (18*a*), and the slide base plate (19) connected through the support pins (18*c*1, 18*c*2) is driven forward. The curved member (20) held on the slide base plate (20) begins to move forward in an arcuate path.

The back plate (21) secured on the curved member (20) moves forward up to a position above the position where the binding string is fed out. As the slide base plate (19) moves forward, the rocker arm (22) also moves forward. Since the guide slide pin (22*b*) at the rear end of the rocker arm (22) moves along the drive guide slot (10*b*3) in the base plate (10*b*), the guide slide pin (22*b*) turns downward clockwise. Then the curved member (20) in engagement with the gear portion (22*a*) of the rocker arm (22) begins to rotate counterclockwise on the slide base plate (19), and further rotates quickly while the objects to be bound are taken into the hook-shaped recess.

At first the binding string is fed out between the spacers (11*a*, 11*b*) in the direction obliquely upward over the vicinity of the objects to be bound. When the front end of the binding string reaches approximately the position beyond the objects to be bound, the curved member (20) begins to turn around the objects to be bound to press and turn the front end of the binding string from above downward, and further turn in a U shape around the objects to be bound so that the binding string girdles the objects to be bound. Here, since the twisting shaft (27) is arranged in an oblique attitude so that the bound objects are fed out obliquely upward, the cutter body (23*a*) can cut the binding string at a position close to the bound objects.

When the binding string is fed out by a length enough to girdle the objects to be bound, the projection (15*b*1) of the feed amount regulating drive cam (15*b*) comes from under into contact with the projection (14*a*1) of the regulator plate (14*a*) secured to the release arm (14) so that the release arm (14) is raised and rotated counterclockwise. Then the feed roller (12*a*) which has been pressing the binding string from above against the feed roller (12*b*) is moved upward, and the feed roller begins idle turning. Here, even if a force is exerted to pull the binding string in the reverse direction, the binding string cannot be drawn out in the reverse direction as long as the feed roller (13*a*) is pressing the binding string against the feed roller (13*b*) because the feed roller (13*b*) with a built-in one-way clutch cannot rotate in the reverse direction. When the gear portion (15*a*1) of the partially cogged gear (15*a*) runs out, the projection (15*b*1) moves away from the projection (14*a*1) of the regulator plate (14*a*) so that the release arm (14) is returned to the original position and the binding string is not fed out any more because the feed roller (12*b*) does not rotate.

When the feeding of the binding string is stopped and the fore-end of the curved member (20) presses the end of the binding string against the objects to be bound, the projection (15*e*1) formed on the rotary cam (15*e*) begins to contact the end of the cutter drive arm (23*d*) to rotate the cutter drive arm (23*d*) counterclockwise about its axis. Then the cutter body (23*a*) also rotates counterclockwise, and the cutter blade (23*b*) held at the end of the cutter body slides downward while being pressed by the spring (23*c*) against the counter blade (24). As a result, the binding string being fed out through the U-shaped opening of the counter blade (24) is cut by a guillotine action.

Along with the rotation of the cutter body (23*a*), the holding plate (25) rotates, and its downwardly bent end presses the tail end portion of the binding string against the twisting head (29), and the curved member (20) presses the front end of the binding string against the twisting head (29). Then the stopper (28) of the twisting shaft (27) is released from the larger radius portion (15*e*2) of the rotary cam (15*e*), faces the smaller radius portion (15*e*3), engages with the gear teeth row (15*a*4) of the cam (15*e*) to start the rotation of the twisting shaft (27). Then, as shown in FIG. 17, the S-shaped twisting head (29) takes both ends of the binding string into its two openings, twists those ends and bind them together.

About the time the twisting head (29) begins to twist both ends of the binding string, the projection (15*c*1) of the manual drive cam (15*c*) begins to come into contact with the projection (17*a*2) of the swing cam (17) to rotate the swing cam (17) in the direction opposite to that described above. As a result, the drive arm (18) also rotates in the opposite direction to reverse the slide base plate (19) supported by the support pins (18*c*1, 18*c*2), and the curved member (20) moves in the direction opposite to that described above to move apart from the objects to be bound. In a similar manner, the projection (15*e*1) of the cam (15*e*) moves away from the cutter drive arm (23*d*), and the cutter body (23*a*) returns to the original position.

When the twisting head (29) twists the ends of the binding string by a specified number of turns, the larger radius portion (15*e*2) of the cam (15*e*) approaches, and the gear (26) disengages from the gear teeth row (15*e*4). The stopper (28) comes into sliding contact with the back surface of the larger radius portion (15*e*2), and the rotation of the twisting shaft (27) stops. When the drive shaft (15) has made one turn, the binding is complete and the electric motor stops its rotation.

FIG. 18 shows the binding machine in a horizontal attitude showing an example of application to a bag for confectionery or the like by inserting the upper portion of the bag into the recesses (10*a*4, 10*b*4) for binding. As shown in the figure, protection covers (30*a*, 30*b*) for safety are attached to both sides of the base plate (10*b*). The binding string is wound on a reel (32) supported by a support plate (31).

Figure 21:
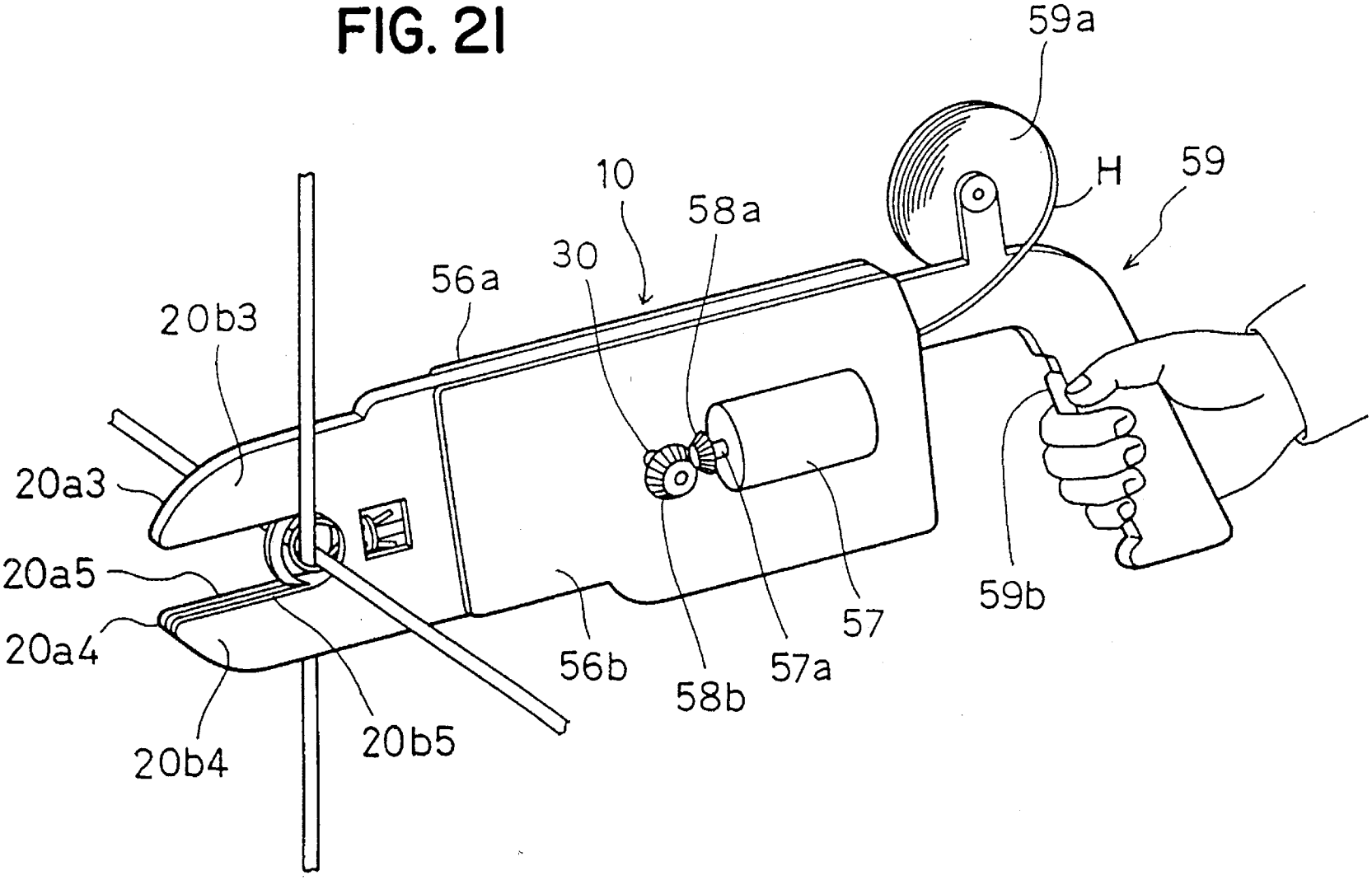
FIG. 21 is a perspective view of crossed iron rods bound by means of the binder.

FIG. 19 shows an example of application of the binder of this invention to binding the flowerpot poles. FIG. 20 shows the application to binding the looped metallic wire. FIG. 21 shows the state of binding crossed iron by inserting the crossed portion into the recesses (10*a*4, 10*b*4). As shown in the figures, in this embodiment, the electric motor is arranged to the right of the base plate (10*b*) and a handle (33) is provided for easy portability. The handle (33) is provided with a switch (34) which is constituted to perform one binding with one push on the switch (34).

As described above, the slide base plate (19) is moved back and forth in an arcuate path while the drive arm (18) swings about its axis. Along with the back and forth movement of the hook-shaped curved member (20) held on the slide base plate (19), the guide slide pin (22*b*) of the rocker arm (22) moves within the drive guide slot (**10*b*3) in the base plate (10*b*) to rotate the rocker arm (22) so that the curved member (20) connected to it is turned quickly. As described above, since the curved member (20**) makes the arcuate back and forth movement while it is pressed against the binding string, the binding is performed with a simple mechanism.

We claim:

1. A binder for joining a plurality of objects together with a binding string, said binder comprising:

a base member having a recess for receiving said objects therein, means for feeding said binding string disposed behind said recess, a hook-shaped hand for guiding said binding string around said objects and for causing a loose end of said binding string to turn back in a U shape while pressing said binding string against said objects to be bound, and for twisting said loose end of said binding string with another portion of said binding string to perform binding, wherein said hook-shaped hand includes:

a slide base plate capable of moving backward and forward relative to said recess, a hook-shaped curved member rotatably coupled to said slide base plate and movable backward and forward in response to movement of said slide base plate, and a rotation mechanism for engaging and thereby rotating said hook-shaped curved member toward said recess in synchronized relation with forward movement of said slide base plate.

2. A binder according to claim 1 wherein said slide base plate is movable back and forth while swinging about a rotary axis thereof.

3. A binder according to claim 2, wherein said rotation mechanism is rotatably supported on said slide base plate in association with said curved member.

4. A binder according to claim 2, further comprising:

a drive side cam and a driven side cam for rotary movement, wherein said slide base plate is movable in a swinging manner thus causing said drive side cam and said driven side cam to engage with each other.

5. A binder according to claim 1, wherein said rotation mechanism is rotatably supported on said slide base plate in association with said curved member.

6. A binder according to claim 5, further comprising:

a drive side cam and a driven side cam for rotary movement, wherein said slide base plate is movable in a swinging manner thus causing said drive side cam and said driven side cam to engage with each other.

7. A binder according to claim 5, further comprising:

a drive side cam and a driven side cam for rotary movement, wherein said slide base plate is movable in a swinging manner thus causing said drive side cam and said driven side cam to engage with each other.

8. A binder according to claim 1, further comprising:

a drive side cam and a driven side cam for rotary movement, wherein said slide base plate is movable in a swinging manner thus causing said drive side cam and said driven side cam to engage with each other.

9. A binder according to claim 1 wherein said rotation mechanism is coupled to said slide base plate for movement therewith, said hooked-shaped curved member having a gear portion in meshing engagement with a gear portion of said rotation mechanism.

* * * * *